United States Patent [19]

Jamzadeh et al.

[11] Patent Number: 4,806,980

[45] Date of Patent: Feb. 21, 1989

[54] DYNAMIC FEEDFORWARD PROCESS CONTROL FOR ELECTROGRAPHIC MACHINES

[75] Inventors: Fereidoon S. Jamzadeh, Fairport; Michael D. Stoudt, Webster, both of N.Y.

[73] Assignee: Eastman Kodak Company, Rochester, N.Y.

[21] Appl. No.: 927,639

[22] Filed: Nov. 6, 1986

[51] Int. Cl.[4] ..... G03G 15/00

[52] U.S. Cl. ..... 355/14 E; 355/14 R

[58] Field of Search ..... 355/3 CH, 4, 14 E, 14 D, 355/14 R, 3 DD

[56] References Cited

U.S. PATENT DOCUMENTS

| | | | |
|---|---|---|---|
| 2,956,487 | 10/1960 | Giaimo | 355/14 D |
| 3,438,705 | 1/1969 | King . | |
| 3,815,988 | 6/1974 | McVeigh . | |
| 3,877,413 | 4/1975 | Rowell et al. | 118/7 |
| 3,918,395 | 11/1975 | Fearnside . | |
| 4,128,329 | 12/1978 | Kawano . | |
| 4,129,375 | 12/1978 | Miyakawa . | |
| 4,256,401 | 3/1981 | Fujimura et al. | 355/14 E |
| 4,284,344 | 8/1981 | Okamoto et al. | 355/14 E |
| 4,306,804 | 12/1981 | Sakamoto | 355/14 D |
| 4,310,237 | 1/1982 | Gengelbach | 355/14 E |
| 4,319,544 | 3/1982 | Weber . | |
| 4,326,796 | 4/1982 | Champion et al. | 355/14 CH |
| 4,408,871 | 10/1983 | Kojima | 355/14 D |
| 4,432,634 | 2/1984 | Tabuchi | 355/14 D |
| 4,451,137 | 5/1984 | Farley | 355/14 C |
| 4,477,176 | 10/1984 | Russel | 355/4 |
| 4,502,777 | 3/1985 | Okamoto et al. | 355/14 R |
| 4,502,778 | 3/1985 | Dodge et al. | 355/14 E |
| 4,587,536 | 5/1986 | Saito et al. | 355/4 |
| 4,627,712 | 12/1986 | Usami | 355/14 R |

FOREIGN PATENT DOCUMENTS

| | | | |
|---|---|---|---|
| 138668 | 8/1982 | Japan | 355/14 D |
| 173566 | 9/1985 | Japan | 355/14 C |
| 178469 | 12/1985 | Japan | 355/14 R |
| WO81/02936 | 10/1981 | World Int. Prop. O. . | |

OTHER PUBLICATIONS

Patent Abstracts of Japan, vol. 9, No. 6, (P-326)(1729), Jan. 11, 1985.

*Primary Examiner*—A. T. Grimley
*Assistant Examiner*—Ed Pipala
*Attorney, Agent, or Firm*—Milton S. Sales

[57] ABSTRACT

The specification discloses apparatus by which multiple reproductions can be produced from an original, all reproductions from the same original being of substantially identical quality. An electrographic machine substantially uniformly charges an electrographic recording member to a predetermined initial voltage and imagewise exposes the charged recording member at a nominal exposure level to produce a latent charge image. The initial voltage level and the exposure level are process control parameters of the machine, which also includes a biased electrode for controlling deposition of toner to the latent charge image. Signals are produced and stored having values characteristic of (1) the level of at least one of the parameters and (2) the bias voltage level which are associated with a desired reproduction quality of an original. A comparison signal is produced by taking the signal values of the sensed parameters associated with latent charge images of successive reproductions of an original and comparing them with the stored signal values for the corresponding latent charge images of the same original. The bias voltage level associated with the latent charge image is varied in response to the comparison signal, thereby producing a developed image having substantially the same upright quality as that produced by the stored signal values.

2 Claims, 4 Drawing Sheets

DYNAMIC FEEDFORWARD PROCESS CONTROL FOR ELECTROGRAPHIC MACHINES

BACKGROUND OF THE INVENTION

1. Field of the Invention

This invention relates to electrographic machines for copying and/or printing, and more particularly to the maintenance of high image quality when multiple copies or prints are made from the same original.

2. Description of the Prior Art

It is often desirable to make copies or prints (herein referred to collectively as "reproductions") of the same original. To optimize quality and, at the same time, assure that all reproductions of the same original are of identical quality, it is known to store machines process control parameter values corresponding to desired exposure and contrast levels, and to use such stored values to control the quality of each reproduction of plural runs of a multiple original document.

For example, in commonly assigned U.S. Pat. No. 4,350,435, issued on Sept. 21, 1982 to Fiske et al, there is disclosed an electrophotographic copier having a memory for storing a matrix array of sets of machine process control parameters, each set having values corresponding to specific levels of initial charge $V_0$, exposure $E_0$, and development electrode bias voltage $V_B$. The operator selects a particular set for each original by a trial and error routine, the set chosen being that which produces the most desired copy quality for each original. The selected set is then stored in a memory and, when it comes time to copy a particular original, the stored set is recalled to control charging, exposure, and bias voltage.

Once the proper set of process control parameters is stored for each original in a document, uniform point quality will be achieved for every copy of each original so long as the charging and exposing stations of the machine function to identically charge and expose the recording member each time a copy or print of a particular original is to be made. However, slight changes in $V_0$ and $E_0$ may occur from one copy to another due to electrical transients. In black and white electrographic systems, the effect of such transients is usually non-discernable to the human eye. However, in color electrographic systems which produce full (i.e., continuous tone) color images, only a few volts variation in charging level, or a fraction of a stop in exposure, can produce readily detectable shifts in hue or color saturation or tone reproduction.

SUMMARY OF THE INVENTION

It is an object of this invention to provide apparatus by which multiple reproductions can be produced from an original, all reproductions from the same original being of substantially identical quality.

The apparatus of the invention is useful in electrographic machines of the type comprising means for uniformly charging an electrographic recording member to a predetermined initial voltage and means for imagewise exposing the charged recording member at a nominal exposure level to produce a latent charge image. The initial voltage level and the exposure level are process control parameters of the machine, which also includes developing means, including an electrode, for controlling deposition of toner to the latent charge image. Means are provided for biasing the electrode at a nominal bias voltage.

In accordance with the present invention, the apparatus comprises sensing means for producing signals having values characteristic of (1) the level of at least one of the parameters and (2) the bias voltage level which are associated with a latent charge image. Means are operatively coupled to said sensing means for storing the signal values (corresponding to various positions on the latent charge image) which cooperate to produce a desired reproduction quality of an original. A comparison signal is produced by comparing the signal values of the sensed parameters associated with latent charge images of successive reproductions of an original with the stored signal values for the corresponding latent charge images of the same original. The bias voltage level associated with the latent charge image is varied throughout the length of the image in response to the comparison signal, thereby producing a developed image having substantially the same print quality as that produced by the stored signal values.

The invention and its advantages will become more apparent to those skilled in the art from the ensuing detailed description of preferred embodiments.

BRIEF DESCRIPTION OF THE DRAWINGS

The subsequent description of the preferred embodiments of the present invention refers to the attached drawings, wherein:

FIG. 4 is a block diagram similar to FIG. 3 with noise and disturbances accounted for.

DESCRIPTION OF THE PREFERRED EMBODIMENT

Figure 1:
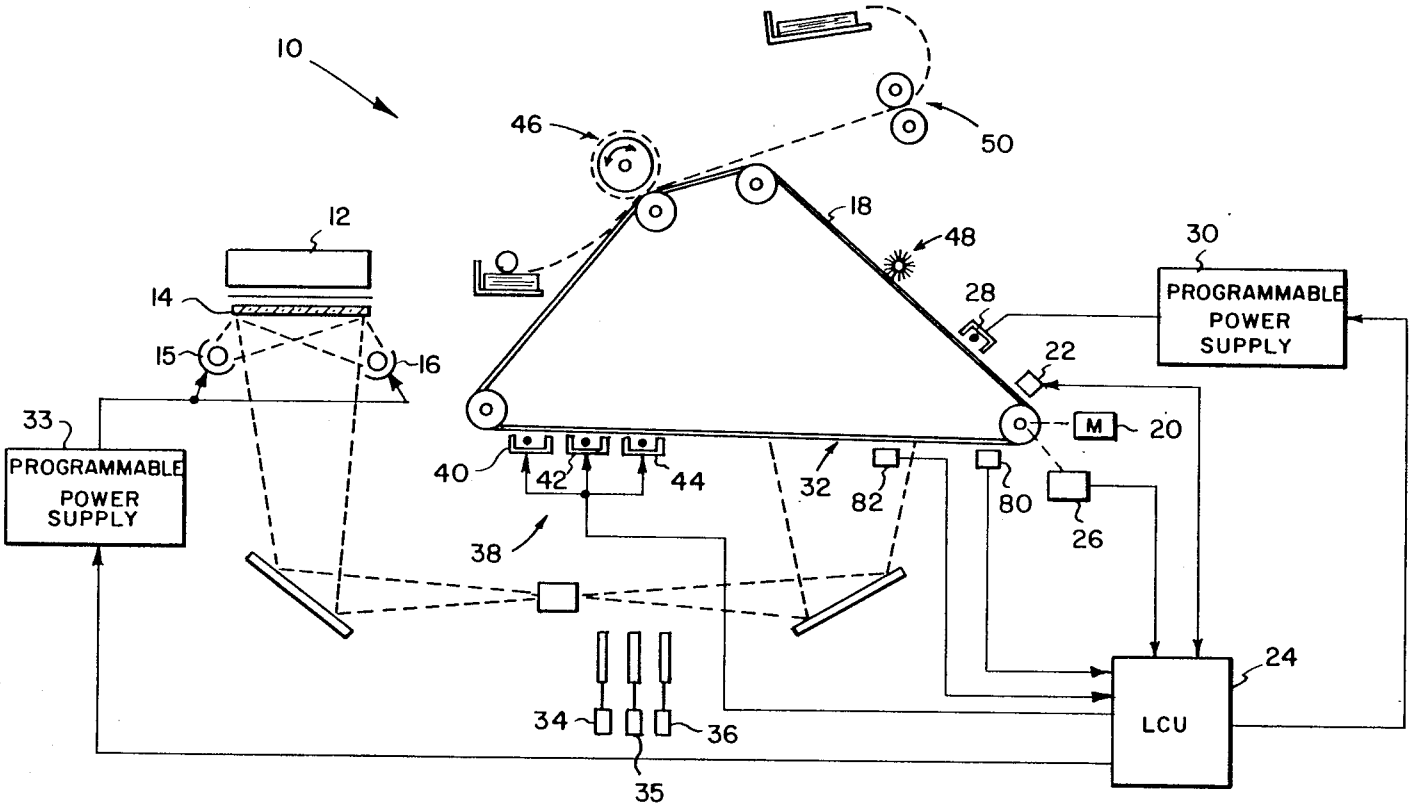
FIG. 1 is a schematic showing a side elevational view of a copier, feeder, and a logic and control unit in accordance with the invention.

The present invention is described below in the environment of an electrophotographic copier having a recirculating document feeder. At the outset, it will be noted that although this invention is suitable for use with such machines, it also can be used with other types of electrographic copiers or printers. Whenever the term "original" is used, it refers to a page of image information to be reproduced, regardless of form. That is, an original may be a sheet of paper or may be a series of electrical signals. The term "document" refers to one or more originals to be reproduced during a production run. Although the illustrative, preferred embodiment shows a full color copier, the invention is applicable also to printers and to black and white reproduction.

Contrast and Exposure Control

For a detailed explanation of the theory of copier contrast and exposure control by controlling initial voltage, exposure, and bias voltage, reference may be made to the following article: Paxton, Electrophotographic Systems Solid Area Response Model, 22 Photographic Science and Engineering 150 (May/June 1978). $D_{in}$ refers to original document reflective density, and $D_{out}$ refers to copy reflective density. To facilitate understanding, the following terms are defined:

$V_B$=Development station electrode bias.

V=Initial voltage (relative to ground) on the photoconductor just after the charger.

$V_F$=Photoconductive voltage (relative to ground) just after exposure.

$E_0$=Light produced by the flash lamps.

E=Actual exposure of photoconductor. [Light produced by the flash lamps ($E_0$) is reflected off of a portion of a document having a particular density $D_{in}$ onto the photoconductor and causes a particular level of exposure E of the photoconductor].

Contrast and density control is achieved by the choice of the levels of $V_0$, $E_0$, and $V_B$.

Feeder, Exposure, and Recording Member

A three color copier 10 includes a recirculating feeder 12 positioned on top of an exposure platen 14. The feeder may be similar to that disclosed in commonly assigned U.S. Pat. No. 4,076,408, issued Feb. 28, 1979, wherein a plurality of originals can be repeatedly fed in succession to the exposure platen.

At exposure platen 14, originals are illuminated by a pair of xenon flashlamps 15 and 16 with an intensity $E_0$, as described in commonly assigned U.S. Pat. No. 3,998,541, issued Dec. 31, 1976. An image of the illuminated original is optically projected with an exposure intensity E onto one of a plurality of sequentially spaced, non-overlapping image areas of a moving recording member such as photoconductive belt 18.

Photoconductive belt 18 is driven by a motor 20 past a series of work stations of the copier. The belt includes timing marks which are sensed, such as by a signal generator 22 to produce timing signals to be sent to a computer controlled logic and control unit (LCU) 24. An encoder 26 also produces timing signals for the LCU. A microprocessor within LCU 24 has a stored program responsive to signals from generator 22 and encoder 26 for sequentially actuating the work stations.

The Work Stations

For a complete description of the work stations, see commonly assigned U.S. Pat. No. 3,914,046. Briefly, a charging station 28 sensitizes belt 18 by applying a uniform electrostatic charge of predetermined initial voltage $V_0$ to the surface of the belt. The output of the charger is controllable by a programmable power supply 30, which is in turn controlled by LCU 24 to adjust voltage $V_0$.

The inverse image of the original is projected onto the charged surface or belt 18 at an exposure station 32. The image dissipates the electrostatic charge and forms a latent charge image. A programmable power supply 33, under the supervision of LCU 24, controls the exposure $E_0$ (intensity and duration) of light produced by lamps 15 and 16. This, of course, adjusts the exposure E of belt 18, and thereby the voltage $V_F$ of the photoconductor just after exposure. For a specific example of such an exposure station and programmable power supply, see U.S. Pat. No. 4,150,324, issued Aug. 8, 1978.

The illustrated copier is adapted to reproduce three-color copies. The original is illuminated, for example, three times in succession to form three separate latent charge image frames of the original. On successive illuminations, a red filter 34, a green filter 35, or a blue filter 36 is inserted into the light path to form color separation latent charge images at exposure station 32.

As understood in the art, provision may be made for a fourth exposure for areas to be developed in black, if desired. The timing of the flash of lamps 15 and 16 and the insertion of filters 34–36 are controlled by LCU 24.

Travel of belt 18 brings the areas bearing the latent charge images into a development area 38. The development area has a plurality of magnetic brush development stations, corresponding to the number of formed color separation images (plus black if used), in juxtaposition to, but spaced from, the travel path of the belt. Magnetic brush development stations are well known; for example, see U.S. Pat. Nos. 4,473,029 to Fritz et al and 4,546,060 to Miskinis et al.

When the color separation images are red, green, and blue, there are three development stations respectively containing complementary colored toner particles, i.e., cyan particles in station 40, magenta particles in station 42 and yellow particles in station 44. The toner particles are agitated in the respective developer stations to exhibit a triboelectric charge of opposite polarity to the latent imagewise charge pattern.

The logic and control unit 24 selectively activates the development stations in relation to the passage of the image areas containing corresponding latent color separation images through development area 38 to selectively bring one magnetic brush into engagement with the belt. The charged toner particles of the engaged magnetic brush are attracted to the oppositely charged latent imagewise pattern to develop the pattern.

As is well understood in the art, conductive portions of the development station, such as conductive applicator cylinders, act as electrodes, and are electrically connected to a variable supply of D.C. potential controlled by LCU 24 for adjusting the development electrode bias voltage $V_B$.

The copier also includes a transfer station 46 and a cleaning station 48, both fully described in commonly assigned U.S. patent application Ser. No. 809,546, filed Dec. 16, 1985. After transfer of the unfixed toner images to a copy sheet, such sheet is transported to a fuser station 50 where the image is fixed to the sheet.

Logic and Control Unit (LCU)

Programming commercially available microprocessors is a conventional skill well understood in the art. The following disclosure is written to enable a programmer having ordinary skill in the art to produce an appropriate control program for such a microprocessor. The particular details of any such program would depend on the architecture of the designated microprocessor.

Figure 2:
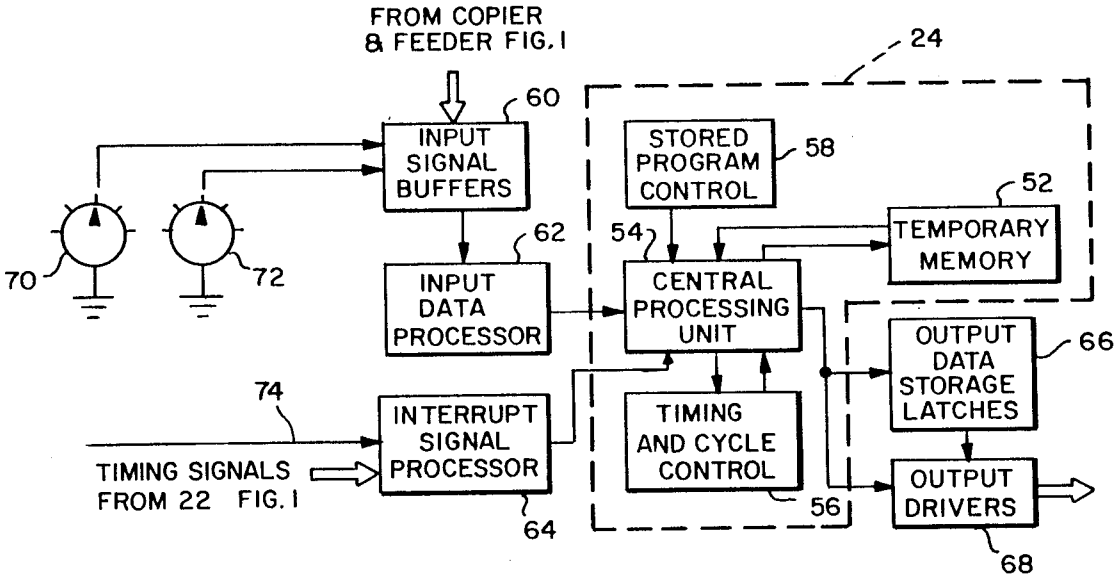
FIG. 2 is a block diagram of the logic and control unit shown in FIG. 1.

Referring to FIG. 2, a block diagram of a typical logic and control unit (LCU) 24 is shown which interfacing with copier 10 and feeder 12. LCU 24 consists of temporary data storage memory 52, central processing unit 54, timing and cycle control unit 56, and stored program control 58. Data input and output is performed sequentially under program control. Input data are applied either through input signal buffers 60 to an input data processor 62 or through an interrupt signal processor 64. The input signals are derived from various switches, sensors, and analog-to-digital converters.

The output data and control signals are applied directly or through storage latches 66 to suitable output drivers 68. The output drivers are connected to appropriate subsystems.

Set-Up Operation

Information representative of a particular set of machine process control parameters is designated by an exposure knob 70 and a contrast knob 72, which provide inputs to buffers 60. Located in stored program control 58 memory is a matrix array of such sets as described in the above-identified Fiske et al U.S. Pat. No. 4,350,435.

Control knobs 70 and 72 correspond to eighty-one sets of process control parameters, which in turn correspond to different $D_{in}/D_{out}$ response curves. The first knob 70 functions as an exposure control and translates the breakpoint of the $D_{in}/D_{out}$ curve. When knob 72 is turned, any one of nine different copy contrasts can be designated.

To make single or multiple copies (non-production run condition) of an original and to obtain a copy representative of the conditions designated by the exposure and contrast knobs, a special print copy button must be depressed. The depression of the button sends a signal along line and causes the copy to be produced in accordance with the $E_0$, $V_0$ and $V_B$ conditions specified by knobs 70 and 72.

During set-up, the operator identifies originals which require special consideration, and adjusts knobs 70 and 72 until copies of that original have the desired contrast and density. LCU 24 now enters into temporary memory 52 the $V_0$, $E_0$ and $V_B$ values for the entire length of each original that needed special consideration. The resolution of stored data depends on the resolution of the timing pickups 26 and 22. The operator now returns knobs 70 and 72 to their normal position, if it is desired to make the other copies at this setting. The copier now initiates a production run of the multiple-original document with each copy having contrast and density in accordance with the stored process control parameter information, or with normal contrast and density, as applicable.

Feedforward Control

As the name indicates, feedforward process control detects noise or disturbance as it occurs, and begins correcting compensation immediately. Feedforward acts in an anticipatory manner before the results of noise or disturbance can affect the results, whereas feedback control acts after the fact in a compensatory manner. In general, the feedforward configuration of the present invention measures a disturbance or noise directly and commands the control action to eliminate the impact of the disturbance or noise on the system before the final output is affected. Feedback controllers can't achieve this because they react only after they have detected a deviation in the value of the final output from the desired set values.

In general, the apparatus and method of the present invention operates such that once a reproduction is made in which contrast and density (or color balance and tone for color reproductions) are acceptable, the levels of the process control parameters are stored in memory. This will be the reference reproduction, and the objective is to make the subsequent reproductions of the same original resemble the reference as much as possible. Normally, LCU 24 will command the same process control parameters for subsequent reproductions of that original. However, if because of a noise or disturbance, one or more of the actual process control parameters if not set at the desired value, the deviation is detected, measured, and used to modify another of the parameters to return the reproduction toward the accepted reference.

An initial charge error signal is generated by comparing the after-charging belt voltages of the reference and the subsequent reproductions. These voltages are read by an electrometer 80 (FIG. 1). An exposure value error signal may be generated by comparing the voltage of the exposure unit capacitors of the reference and the subsequent reproductions. Exposure value error signals may also be generated by direct measurement of the actual exposure E of belt 18 by means of a light sensor 82.

Once these comparison signals are detected and measured, it is possible to compute their effects on the prints and to compensate for these defects at the time of development by adjusting the bias $V_B$ of the development station electrode.

Philosophy of Operation

Figure 3:
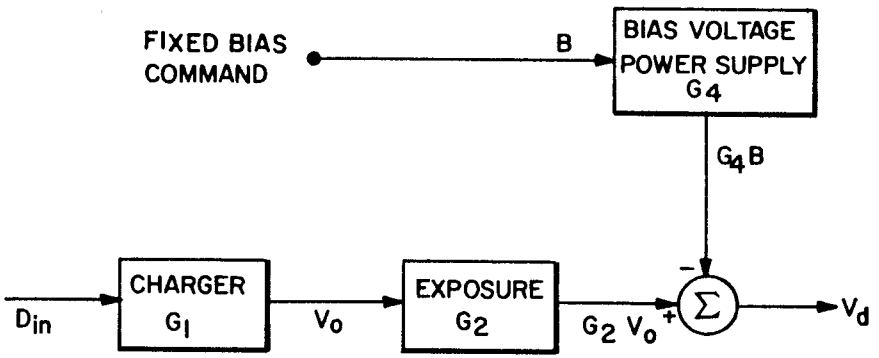
FIG. 3 is a block diagram of the process of the copier of FIG. 1 assuming a system without noise of other disturbances.

FIG. 3 is a block diagram of the process, assuming a perfect system without noise or disturbances. Charging station 28 is assumed to have a transfer function $G_1$, exposure station 32 has a transfer function $G_2$ and the development electrode bias supply has a transfer function $G_4$. Assuming that every subsystem acts linearly, the effective voltage $V_d$ on belt 18 at the time of development will be:

$$V_d = G_2 V_0 - G_4 B \tag{1}$$

where $V_0$ is the desired initial voltage after the charger and B is the fixed bias command. Equation (1) relates to the ideal case where development voltage is only a function of the process subsystems.

Figure 4:
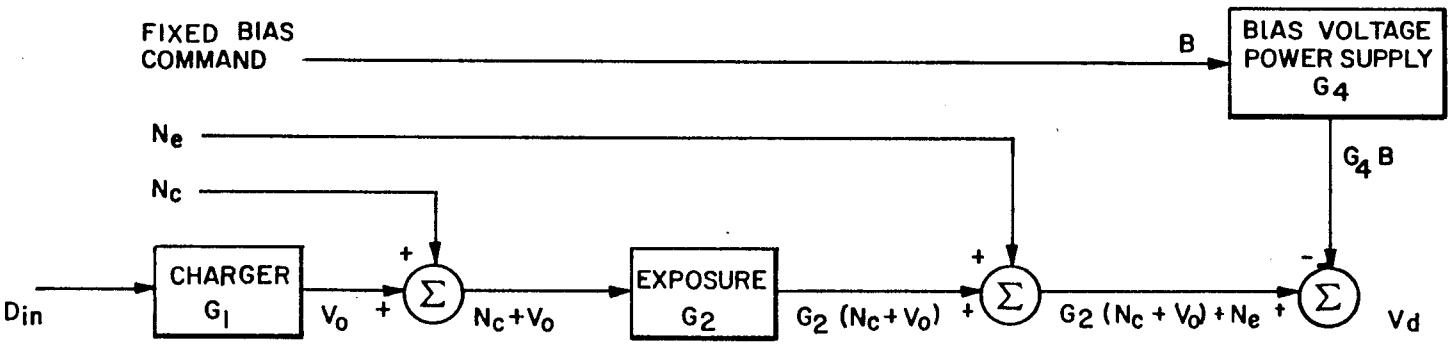

FIG. 4 is a block diagram of the same system when noise and disturbance $N_c$ for the charger and and $N_e$ for exposure are considered. The effective voltage $V_d$ on belt 18 at the time of development can thus be shown to be:

$$V_d = G_2(N_c + V_0) + N_e - G_4 B \tag{2}$$

Equation (2) corresponds to normal situations in which noise and disturbance affect the effective development voltage.

Figure 5:
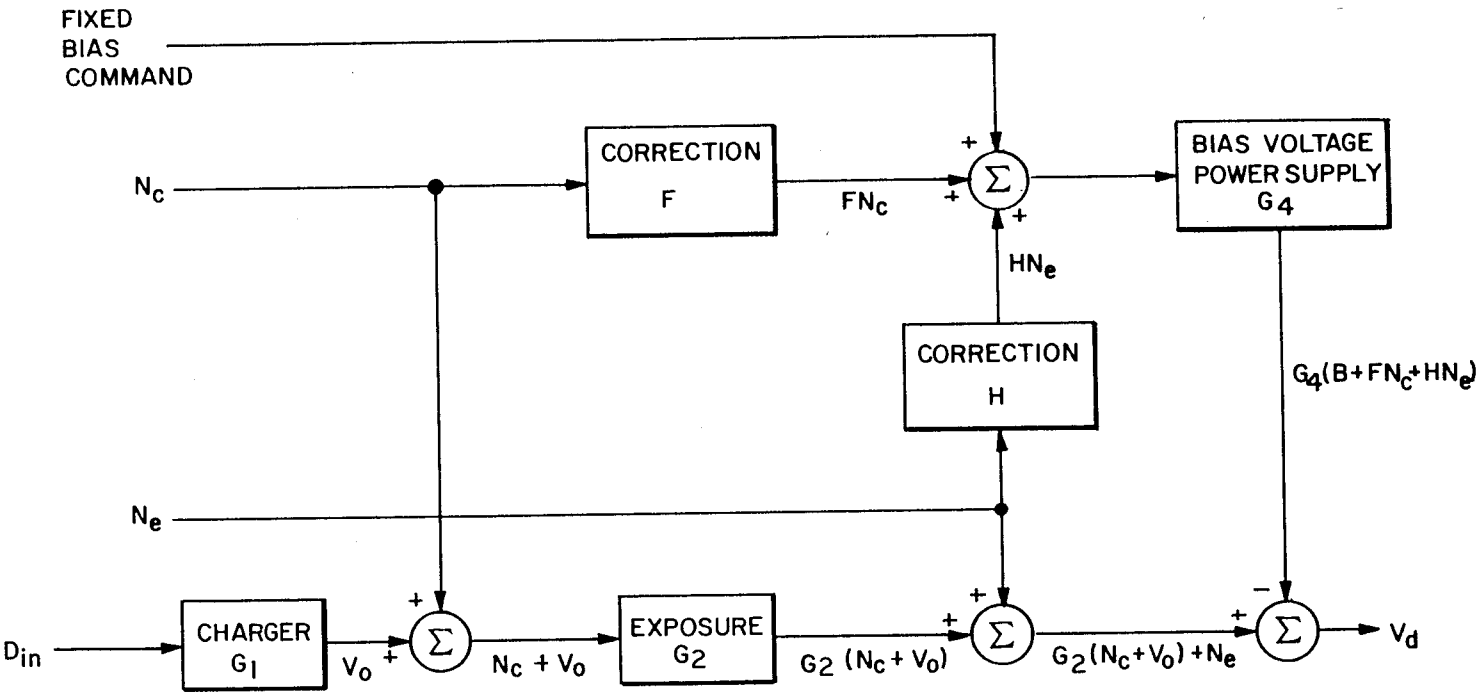
FIG. 5 is a block diagram similar to FIG. 4 with compensation for noise and disturbances.

FIG. 5 is a block diagram in accordance with a preferred embodiment of the present invention, and shows the provision of compensation for noise and disturbance $N_c$ and $N_e$. The noise and disturbance signals are transformed by correction functions F and H, such that the effective voltage $V_d$ on belt 18 at the time of development will be:

$$V_d = G_2(N_c + V_0) + N_e - G_4(B + FN_c + HN_e)$$

or $$V_d = N_c(G_2 - G_4 F) + N_e(1 - G_4 H) + G_2 V_0 - G_4 B \tag{3}$$

Equation (3) suggests how corrective functions "H" and "F" can completely eliminate the effects of noise and disturbances. In other words if:

$F = G_2/G_4$, and $H = 1/G_4$, then "$V_d$" will be independent of "$N_c$" and "$N_e$" and equation (1) will apply. It can therefore be seen that feedforward control can result in theoretically ideal operation. One need only define accurate models for the subsystems "F" and "H" for good response.

Compensation Algorithms

If linear models are assumed for compensation algorithms, the difference $\Delta V_B$ between the bias voltage $V_B$ for a given print or copy and the bias voltage $V_B$ when the reproduction or copy was made should be:

$$\Delta V_B = K\Delta V_0 + C \quad (4)$$

to compensate for noise and disturbance in the initial charge $V_0$, where K and C are two constants defined experimentally. If used in color reproduction, different constants should be used for each color since different colors have different levels of initial charge $V_0$.

To compensate for noise and disturbances in exposure $E_0$, corrections to the bias voltage $V_B$ are given by:

$$V_B = -K'\Delta E_0 \quad (5)$$

where K' is determined experimentally.

However, it can be shown that the linear assumptions in equations (4) and (5) can be improved upon by the following equation, used to define $V_B$ as a function of $V_0$ and $E_0$ of the print of copy being made and $V_0'$ and $E_0'$ of the reference print:

$$\Delta V_B = (V_0 - V_0')[(1-D)e^{-[S(E_0 - E_0')]} + D] \quad (6)$$

where "D", "S", and "C" are constants of photoconductor discharge characteristics.

Operation

Referring again to FIG. 1, this description will follow a single image area of belt 18 around the belt's path to explain the operation of the machine. It will be assumed that the image area is used to record the cyan image information of a color original at exposure platen 14. Yellow and magenta information will have been recorded on preceeding and/or succeeding image areas of the belt.

Under the control of programmable power supply 30, charging station 28 places a charge $V_0$ on the image area. Electrometer 80 reads the voltage on the image area as it passes, and inputs the information to LCU 24. When the image area reaches exposure station 32, programmable power supply 33 flashes lamps 15 and 16 to expose the image area through raised red filter 34. Exposure level is set at $E_0$, and light sensor 82 records the exposure level and inputs it to LCU 24.

LCU 24 compares $V_0$ and $E_0$ to $V_0'$ and $E_0'$ of the reference reproduction, through the length of image and commands the voltage difference $\Delta V_B$ of the development electrode of cyan development station 40 to a level to compensate for differences between the actual and reference levels of initial voltage and exposure, as determined by equation (6). The image area is then toned at development station 40, and the cyan image is transferred to a copy sheet at station 46 before cleaning at station 48.

Conclusions

From the above, it can be seen that feedforward control effectively reduces the print-to-print variations in high quality reproductions. It corrects for transient as well as sustained disturbances, and will reduce the number of wasted prints, theoretically to zero.

The invention has been described with particular referece to a preferred embodiment thereof, but it will be understood that variations can be effected within the spirit and scope of the invention.

What is claimed is:

1. In an electrographic machine for reproducing originals and having (1) means for substantially uniformly charging a recording member, (2) means for imagewise exposing the charged recording member at a nominal exposure level to produce a latent charge image (3) developing means, including an electrode, for depositing toner on the latent charge image, and (4) means for electrically biasing the electrode at a nominal bias voltage level; the improvement comprising:

means for producing a signal having a value characteristic of the exposure level associated with a latent charge image;

means, operatively coupled to said signal producing means for storing the produced signal value and the nominal bias voltage level which cooperate to produce a first reproduction of an original, said first reproduction having a desired quality;

means for producing a comparison signal by comparing the signal value of the sensed exposure level associated with a subsequent latent charge image with the corresponding stored signal value for the corresponding latent charge image of the same original; and means responsive to said comparison signal for varying the bias voltage level associated with the latent charge image to thereby produce a developed image having substantially the same reproduction quality as that produced by the stored signal values.

2. In an electrographic machine for reproducing color separations of multi-color originals and having (1) means for substantially uniformly charging an image area of a recording member for each color separation, (2) means for imagewise exposing the charged image areas at a nominal exposure level to produce color separation latent charge images, (3) developing means, including an electrode, for depositing appropriately colored toner on the color separation latent charge image, and (4) means for electrically biasing the electrode at a nominal bias voltage level; the improvement comprising:

means for producing a signal having a value characteristic of the exposure level associated with a color separation latent charge image;

means, operatively coupled to said signal producing means for storing the produced signal value and the nominal bias voltage level which cooperate to produce a first reproduction of an original, said first reproduction having a desired quality;

means for producing a comparison signal by comparing the signal value of the sensed exposure level associated with a subsequent color separation latent charge image of an original with the corresponding stored signal value for the corresponding color separation latent charge image of the same original; and means responsive to said comparison signal for varying the bias voltage level associated with the color separation latent charge image to thereby produce a developed color separation image having substantially the same reproduction quality as that produced by the stored signal values.

* * * * *